United States Patent [19]

Scott

[11] 4,217,836

[45] Aug. 19, 1980

[54] ROTARY KNIFE MODULE FOR TUFTING MACHINES

[75] Inventor: Jimmie D. Scott, Harrison, Tenn.

[73] Assignee: Spencer Wright Industries, Inc., Chattanooga, Tenn.

[21] Appl. No.: 947,504

[22] Filed: Oct. 2, 1978

[51] Int. Cl.[2] ..... D05C 15/00

[52] U.S. Cl. ..... 112/79 R; 112/289

[58] Field of Search ..... 112/79 A, 79 R, 289; 26/9

[56] References Cited

U.S. PATENT DOCUMENTS

| | | | |
|---|---|---|---|
| 1,924,715 | 8/1933 | Farrell | 112/79 R |
| 1,956,453 | 4/1934 | Moench | 112/79 R |
| 2,160,090 | 5/1939 | Schmiedel | 112/79 R |
| 2,160,094 | 5/1939 | Schmiedel | 112/79 R |
| 2,176,957 | 10/1939 | Covell | 112/79 R |

FOREIGN PATENT DOCUMENTS

| | | | |
|---|---|---|---|
| 2452226 | 5/1975 | Fed. Rep. of Germany | 112/79 R |

*Primary Examiner*—Ronald Feldbaum
*Attorney, Agent, or Firm*—Alan Ruderman

[57] ABSTRACT

A cut-pile tufting machine is disclosed having a module rotatably supporting a plurality of circular knife blades driven by gears mounted on a common shaft with the blades. The module also carries idler gears in mesh with the drive gears for driving them from gearing on a drive shaft mounted in the tufting machine bed when the modules are installed.

7 Claims, 5 Drawing Figures

ROTARY KNIFE MODULE FOR TUFTING MACHINES

BACKGROUND OF THE INVENTION

This invention relates to tufting machines and more particularly to cut-pile machines of this type having knife blades for cutting loops of yarn while on the hooks shortly subsequent to the formation of the loops.

In conventional cut-pile tufting machines the loops that are formed by the cooperation of the individual needles and loop seizing blade of the hook are severed on the blade to form cut pile. To cut the loop a knife is disposed on one face of each of the hooks having a cutting edge that cooperates with the underside of the loop seizing blade. In such machines the knives are carried by a knife holder secured to an oscillating knife shaft. The knives are formed of spring steel and must be arranged at a slight angle and canter relative to the respective hook to provide tension to insure proper sissor-like cutting action between the cutting edges of the knife and hook. Quite obviously the friction between the knife and hook produces wear on the knives and hooks, and limits the speed of such machines.

To provide proper cutting without having loose or jagged ends of yarn, the cutting edge of the knives must be kept sharp. This requires periodic removal and replacement while the edges are reground. For example, in the typical prior art arrangement, such as illustrated in U.S. Pat. No. 3,386,398 of J. A. Cobble, Sr., et al, two knives are set in a knife block secured to the hook shaft. Since such machines may have 1000 or more knives, replacement and resetting of the knives at the proper angles can be a tedious time consuming operation requiring significant machine downtime and labor.

Modular block constructions have been proposed in attempts to reduce downtime due to knife changes and to extend the life of the knife. For example, in German Auslegeschrift No. 23,49,800 of K-H Zieseniss, a slotted knife block is slidably mounted in a runner rail by means of a dove tail guideway and the runner rail is thereafter conventionally mounted in the knife shaft. The knives are first set in the block on a bench, and the complete block can be replaced as a unit. U.S. Pat. No. 3,212,467 of Wittler illustrates a similar concept. In these and other attempts at modules conventional tufting knives have been used with all their inherent problems.

Other deficiencies with the conventional tufting cutters include the requirement of properly timing the knife shaft to the hook shaft, and what is known as "J" cut. This is the condition where the legs of a cut loop are not the same length and thus the resulting pile height is not level. This results from the knife cutting against one face of the hook while the loop extends about the entire hook section. There have been many attempts to solve this problem using conventional knives, with varying degrees of success. Nonconventional attempts have been made using a rotary cutter acting within a slot cut in the hook. Examples of this approach are illustrated in U.S. Pat. No. 2,103,798 of Taradash, U.S. Pat. No. 3,052,198 of Whitney and Danish Pat. No. 76,466 of Bonnesen. However, these proposed constructions could not be used readily for machines operating at relative high speeds and producing the fine gauge tufted product required by today's market.

In commonly assigned co-pending U.S. Application Ser. No. 872,881 filed Jan. 27, 1978 by J. D. Scott and W. F. Weldon now U.S. Pat. No. 4,141,303 there is disclosed a knife module carrying a plurality of rotary knives drivingly connected to one or more turbine wheels, and a nozzle for each turbine. Each module includes a body cavity for communicating a pressurized fluid from a source to the nozzle, for impinging upon and driving the turbines and hence the knives. Although this arrangement has promise, it does require a separate pressurized air supply and specially designed nozzles to drive the turbines and cutters at a speed that provides good cutting. It was initially felt that because of the spacing and sizing requirements within the tufting machine it was not possible to design a practical mechanically driven knife module that could be easily connected and disconnected in the machine. The present invention, however, provides just such a construction.

SUMMARY OF THE INVENTION

The present invention overcomes the problems of the prior art cut-pile tufting machines by providing a module carrying a plurality of rotary knife blades, each module having its own mechanically driven drive members for cooperating with a drive system in the tufting machine, and being installed and removed readily from the tufting machine in a matter of minutes. It is envisioned that a plurality of such modules may be mounted in the bed of a multi-needle tufting machine.

In the preferred embodiment the module drive system includes at least one drive gear mounted on a common shaft with a plurality of circular knife blades. The gear is driven directly or by means of an idler gear from a drive gear mounted on a shaft in the tufting machine. Each module may be removably secured to a bracket in the machine to engage its gears with the corresponding drive gears of the shaft.

Included among the numerous advantages of this invention is the short downtime required to change cutting knives since a plurality of cutting knives are changed as a unit and individual knife adjustments are not required. Because of the simplified mounting of the cutting knives fine gauge cut-pile tufted products are made more readily possible. Moreover, since rotary cutting blades are used, the blade cutting edge touches only the yarn, so that the rotary cutter advantages of longer cutter life and elimination of "J" cutting is attainable.

Consequently, it is a primary object of the present invention to provide a module carrying a plurality of rotary cutting blades and blade drive members that readily can be installed in a tufting machine.

It is another object of the present invention to provide a yarn cutting module that can be incorporated into a tufting machine for producing fine gauge cut-pile products.

It is a further object of the present invention to provide a yarn cutting module for tufting machines having a plurality of rotary cutters for cutting yarn while on the hooks of a machine without the cutters touching the hooks.

It is a still further object of the present invention to provide a module carrying a plurality of rotary cutters and gearing for driving the cutters.

It is yet another object of the present invention to provide a module for a tufting machine carrying a plurality of rotary cutters, a plurality of drive gears operatively connected to the cutters for rotatably driving them, a drive system in the tufting machine including cooperating gears for driving the drive gears, and quick connecting means for securing the module in the tufting machine with the cooperating gears in meshing relationship.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
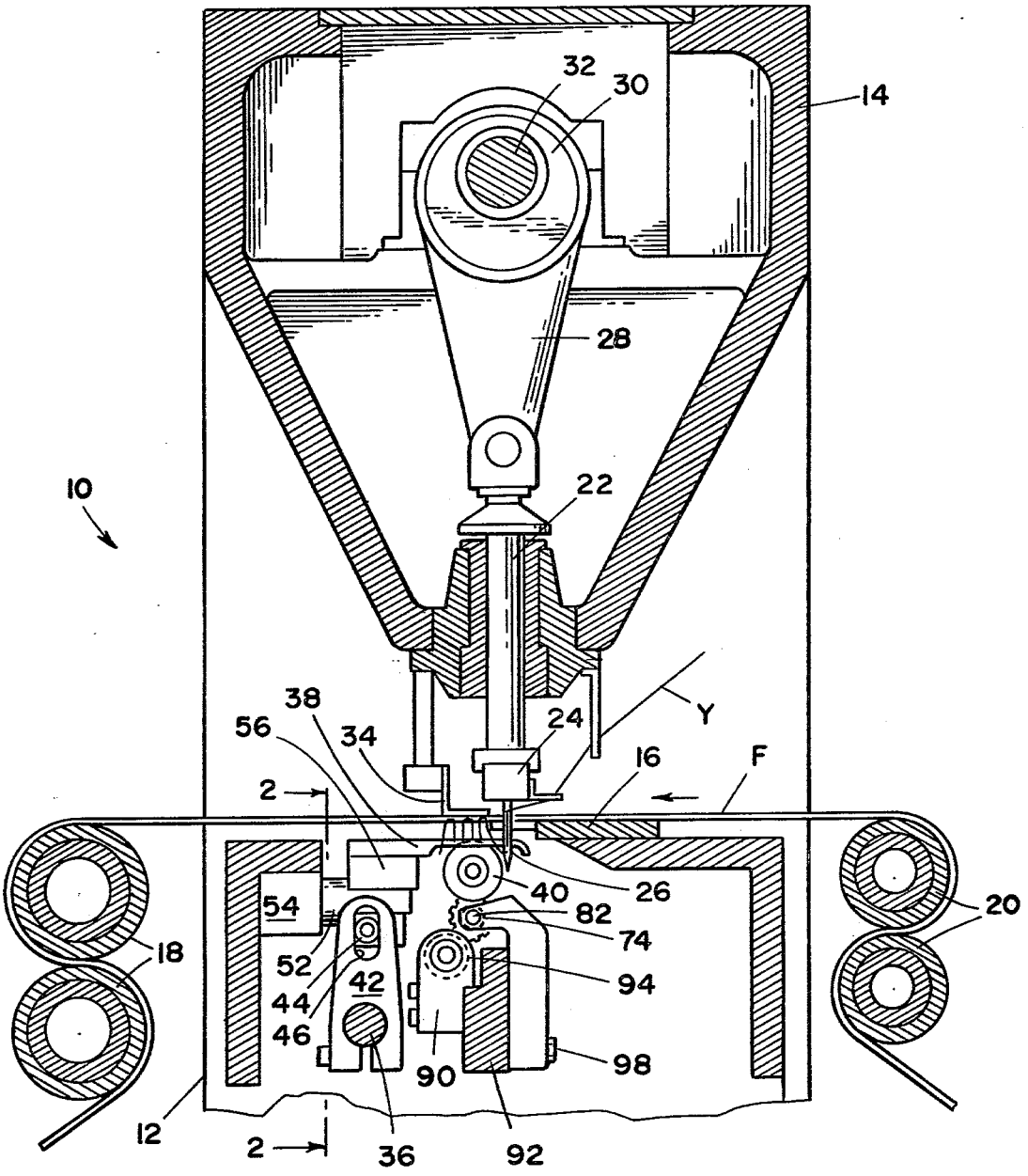
FIG. 1 is a vertical sectional view taken laterally through a tufting machine embodying a cutter module constructed in accordance with the present invention.

Referring now to the drawings, there is illustrated in FIG. 1 a tufting machine 10 having a frame comprising a bed 12 and a head 14 disposed above the bed. The bed 12 includes a bed plate 16 across which a fabric F is adapted to be fed by a pair of feed rolls 18 and take-off rolls 20.

Mounted in the head 14 for vertical reciprocation is one of a plurality of push rods 22 to the lower end of which a needle bar 24 is carried and which in turn carries a plurality of needles 26 that are adapted to penetrate the fabric F on the bed plate 16 upon reciprocation of the needle bar 24 to project loops of yarn therethrough. Endwise reciprocation is imparted to the push rods 22 and thus the needle bar 24 and needles 26 by a link 28 which is pivotably connected at its lower end to the push rods 22 and at its upper end to an eccentric 30 on a driven rotary main shaft 32 that is journalled longitudinally in the head 14. A presser foot assembly 34 may be supported on the head 14 to hold down the fabric F during needle retraction.

Beneath the bed plate 16 there is journalled an oscillating looper shaft 36 arranged parallel to the main shaft 32 for driving a plurality of loopers or hooks 38 in timed relationship with the needle reciprocation. Each hook cooperates with a respective needle 26 to seize a loop of yarn Y presented by the needle and to hold the same as the needle is withdrawn on its return stroke, after which the hooks retract. The loopers being of the cut-pile variety face opposite the direction of feed of the fabric F and as is conventional a number of loops preferably remain on the hooks prior to being cut which in accordance with the present invention is by a sharp rotatable circular knife blade 40. The hooks preferably include a slot (not illustrated) at the bottom for receiving the blade 40 so that the blades touch only the yarn. By means of a hook with a clip and pattern attachment similar to that illustrated in Card U.S. Pat. No. 3,084,645, selected loops may be withdrawn prior to cutting. While, to simplify the disclosure, only a single needle 26 and single looper 38 is shown on a looper member 39 having a plurality of such loopers, it is understood that a multiplicity of such elements are normally provided laterally across the machine, and that the number may be upwards of 1,000 of each such elements.

Because of the cutting action of the rotary cutting blade 40 it is preferable that the movement of the hook be substantially linear. Thus, the oscillating motion of the shaft 36 may be transferred to a yoke 42 having a cam follower 44 fitted within slots 46 in its end portions. The cam followers 44 have pins 48 extending toward the inner portion of the yoke which carry a U-shaped bracket 50. The bracket 50 may be connected in a step to the bottom of a cylindrical member 52 supported for linear movement in a linear bearing 54. The cylindrical member 52 may be connected in a step at its top to a looper bar 56 within which a plurality of loopers are carried. It is to be understood that other linear drive constructions can be utilized and that described is for purposes of disclosure only.

Figure 4:
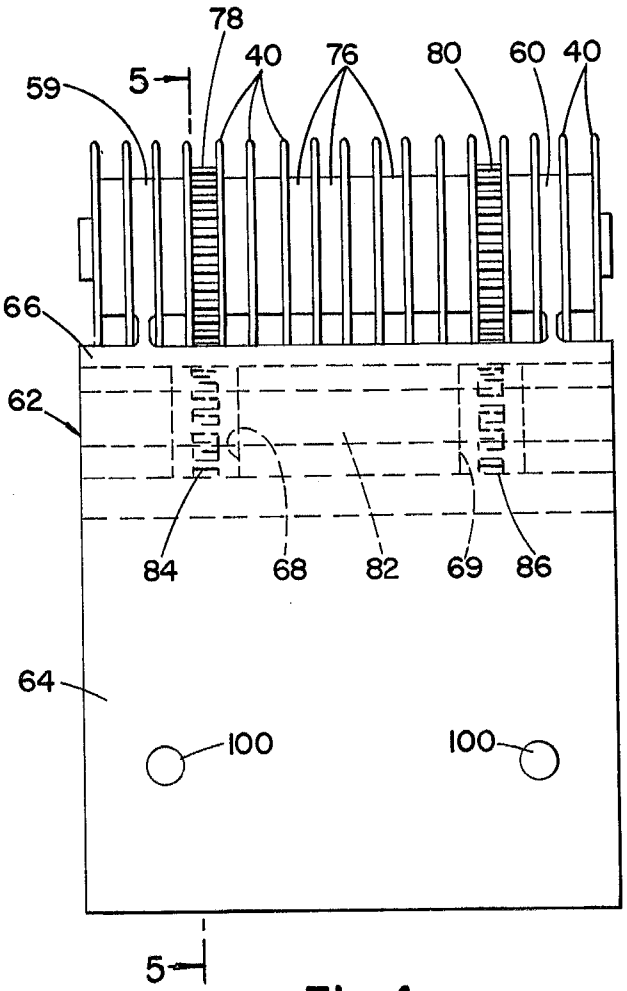
FIG. 4 is an elevational view of the rear of a module body member with the cutting knives and the gears installed.
Figure 5:
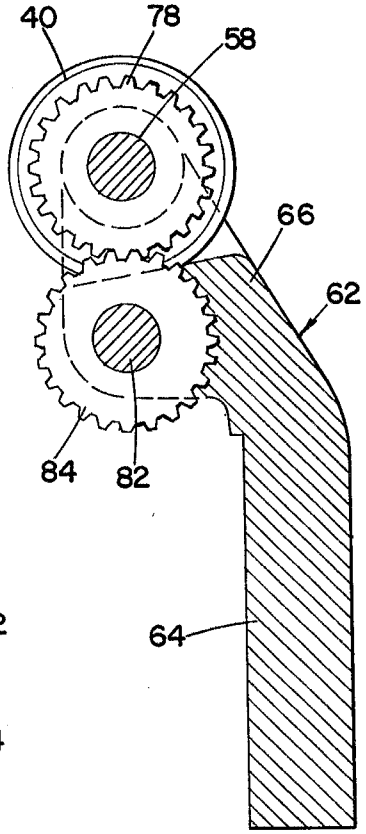
FIG. 5 is a cross sectional view of a module taken substantially along line 5—5 of FIG. 4.
Figure 3:
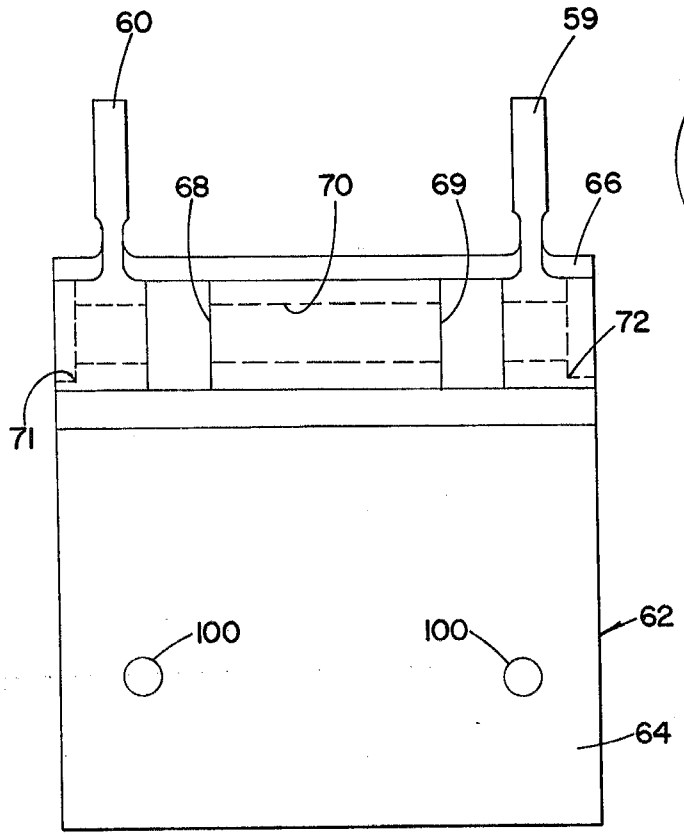
FIG. 3 is an elevational view of the front of a module body member with the cutting knives and the gears removed.

In accordance with the principles of the present invention each knife blade 40 is mounted on a shaft 58 journally carried by a pair of spaced lugs 59 and 60 in a module 62. Any practical number of such knife blades may be carried by a module, there being 17 such blades in the disclosed module, as illustrated in FIG. 4. The guage of the tufting machine will determine the spacing between knives and thus the number of knives and the number of modules will be determined by the number of needles installed in the machine.

As illustrated, the module may comprise a body member having a rectangular mounting portion 64 at the lower part thereof, and a support portion 66 at the upper part thereof. The support portion of the module is angled away from the remainder of the body so as to be offset from and overhang the mounting portion 64 and carries the lugs 59 and 60 upstanding from the top surface thereof. Formed in the support portion 66 intermediate the lugs is at least one, and preferably two slotted openings 68 and 69. A central opening 70 extends longitudinally from end to end through the support portion and through the openings 68 and 69. The ends of the opening 70 are slightly enlarged at 71 and 72 for receiving bearing members 74.

The knife blades 40 are spaced apart on the shaft 58 by spacer members 76 substantially equal to the gauge of the tufting machine except in the vicinity of the openings 68 and 69. Positioned on the shaft 58 substantially above the center of each opening 68 and 69 is a respective toothed gear member 78 and 80 also substantially equal to the gauge. The stack of knives 40, spacers 76 and gears 78 and 80 may be tightly secured together and keyed to the shaft 58 so that they rotate as a unit. Positioned in the bearings 74 in the opening 70 parallel to the shaft 58 is a shaft 82 having gears 84 and 86 keyed thereon within the openings 68 and 69 and having teeth in mesh with the respective gears 78 and 80. The gears 84 and 86 function as idler gears to meet an optimim sizing and spacing requirement when the module is mounted within the tufting machine. These gears drive the gears 78 and 80 and thus the knives 40 when they themselves are driven.

Figure 2:
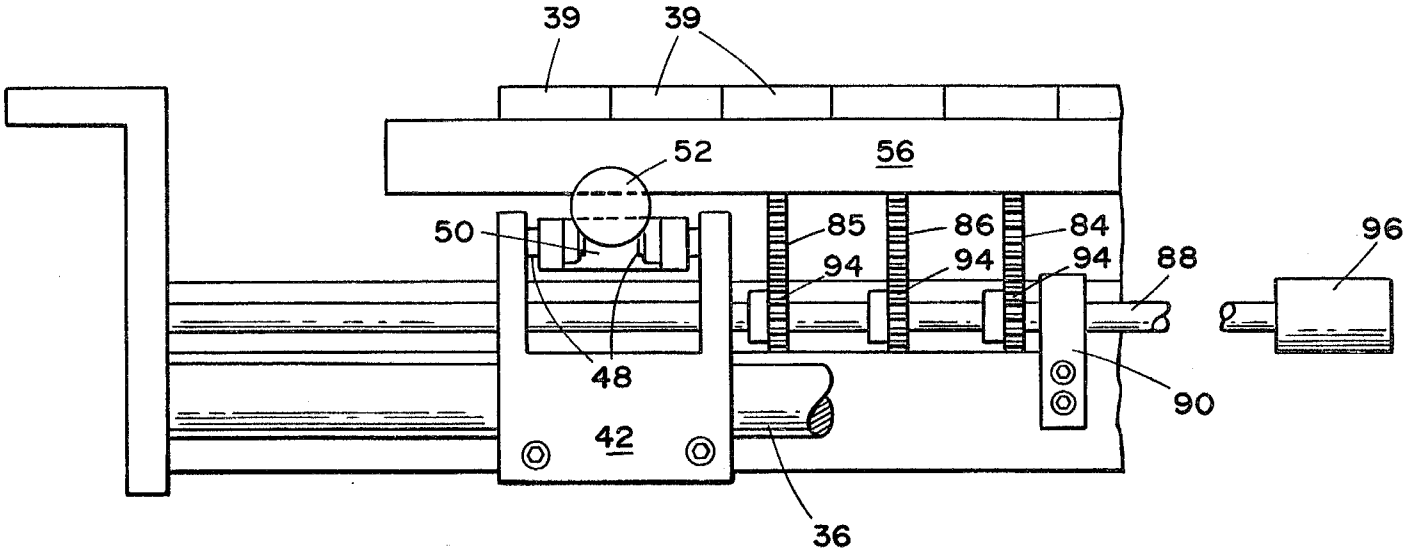
FIG. 2 is a longitudinal sectional view through the bed of the tufting machine taken substantially along line 2—2 of FIG. 1.

In order to drive the gears 84, 86, 78, 80 and thus the knives 40 when the modules are mounted in the bed of the tufting machine, a shaft 88 is provided longitudinally within the bed of the machine. The shaft may be journalled within bearing blocks 90 secured to a bracket 92 within the tufting machine bed. A plurality or drive gears 94 are secured to the shaft 88 and spaced apart by an amount equal to the spacing between the gears 84 and 86 so as to mesh with these idler gears when the module is installed in the tufting machine. The shaft 88 may be driven from the main shaft 32 of the tufting machine or, since timing is not relevant, it can be driven from a separate drive motor 96 at one end of the shaft. Since a number of modules can be mounted within the tufting machine, FIG. 2 illustrates an idler gear 85 from an adjacent module in mesh with one of the gears 94. The modules as illustrated may be installed with the tufting machine on the bracket 92. In order to secure the module the mounting portions 64 of the modules 62 and the bracket 92 have cooperable mounting surfaces, and mounting means such as bolts 98 may pass through apertures 100 within the modules and be threadedly received within the bracket 92. With this modular construction, taking into account the offset between the support portion and the mounting portion, when the bolts 100 secure the modules within the bed of the machine, the gears 94 mesh with the idler gears of the modules. The installation and/or removal thus takes no more than a few minutes.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus described the nature of the invention, what is claimed herein is:

1. A tufting machine having a plurality of reciprocating needles adapted to carry yarn and to penetrate a backing fabric from one side thereof, a loop seizing hook associated with each needle and mounted on the other side of the backing fabric for seizing a loop of yarn presented by the needle to form loops of pile extending from the backing fabric, cutting means associated with at least some of the loop seizing hooks for cutting loops of yarn while on said hooks, said cutting means comprising a module having a plurality of circular knife blades, each cooperating with a respective loop seizing hook, at least one gear member drivingly connected to said knife blades, means for rotatably mounting said knife blades and gear member in said module, a shaft rotatably mounted in said tufting machine, said shaft having at least one drive gear rotatably fixed thereon, means for rotating said shaft, and means for mounting said module in said tufting machine with said drive gear in intermeshing driving engagement with said gear member.

2. In a tufting machine as recited in claim 1 wherein said means for mounting said module includes idler gear means in meshing relationship with said drive gear and said gear member.

3. In a tufting machine as recited in claim 1 wherein said module includes a support portion and a mounting poriton, said knife blades and gear member being mounted in said support portion, said means for mounting said module including said support portion, said support portion being offset from said mounting portion.

4. In a tufting machine as recited in claim 2 wherein each module includes a pair of spaced apart gear members and cooperable idler gear means.

5. In a tufting machine as recited in claim 1 wherein said cutting means includes a plurality of said modules.

6. A rotary knife module having a support portion carrying a plurality of spaced apart circular knife blades, at least one gear member drivingly connected to said knife blades, means including a common shaft for rotatably mounting said knife blades and gear member in said module with the periphery of said blades free for cutting, a corresponding idler gear for each gear member, means for rotatably mounting each idler gear in said module in meshing relationship with the corresponding gear member, and a mounting portion on said module.

7. A rotary knife module as recited in claim 6 wherein said support portion is offset from said mounting portion.

* * * * *